US009839925B2

(12) United States Patent
Loewen et al.

(10) Patent No.: US 9,839,925 B2
(45) Date of Patent: Dec. 12, 2017

(54) METHODS OF CLEANING A SUBMERGED SURFACE USING A FLUID JET DISCHARGING A LIQUID/GAS COMBINATION

(75) Inventors: Eric P. Loewen, Wilmington, NC (US); Brian S. Triplett, Wilmington, NC (US); Brett J. Dooies, Wilmington, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 1023 days.

(21) Appl. No.: 13/609,824

(22) Filed: Sep. 11, 2012

(65) Prior Publication Data

US 2014/0069468 A1 Mar. 13, 2014

(51) Int. Cl.

| | |
|---|---|
| ***B08B 3/00*** | (2006.01) |
| ***B05B 7/06*** | (2006.01) |
| ***B08B 9/093*** | (2006.01) |
| *B08B 3/02* | (2006.01) |

(52) U.S. Cl.

CPC ..... *B05B 7/065* (2013.01); *B08B 9/093* (2013.01); *B05B 7/062* (2013.01); *B08B 3/02* (2013.01)

(58) Field of Classification Search

None

See application file for complete search history.

(56) References Cited

U.S. PATENT DOCUMENTS

| | | | | |
|---|---|---|---|---|
| 3,898,079 | A | 8/1975 | Eriksson | |
| 5,849,091 | A | 12/1998 | Skrovan et al. | |
| 8,123,833 | B2 | 2/2012 | Morita et al. | |
| 2002/0005214 | A1 | 1/2002 | Tomita et al. | |
| 2002/0189641 | A1 | 12/2002 | Sato | |
| 2009/0255558 | A1 | 10/2009 | Inukai et al. | |
| 2010/0199930 | A1 * | 8/2010 | Tandra | F23J 3/023 122/392 |
| 2011/0056525 | A1 | 3/2011 | Karls | |
| 2013/0294977 | A1 * | 11/2013 | Johnston | C01B 21/26 422/162 |

FOREIGN PATENT DOCUMENTS

| | | | | |
|---|---|---|---|---|
| EP | 0607974 | A1 | 7/1994 | |
| JP | 4411355 | Y | 5/1969 | |
| JP | 5776778 | U | 5/1982 | |
| JP | 6354982 | A | 3/1988 | |
| JP | 63107760 | U | 7/1988 | |
| JP | H0347575 | * | 2/1991 | B08B 3/08 |
| JP | 08154880 | A | 6/1996 | |

(Continued)

OTHER PUBLICATIONS

JP2003024758 English Translation, accessed on Sep. 2015.*

(Continued)

*Primary Examiner* — Eric Golightly

*Assistant Examiner* — Arlyn I Rivera-Cordero

(74) *Attorney, Agent, or Firm* — Harness, Dickey & Pierce, P.L.C.

(57) ABSTRACT

A method of cleaning a submerged surface covered by a liquid medium includes injecting a cleaning liquid with a submerged fluid jet through the liquid medium at the submerged surface. The method may also include introducing at least one of a non-reactive gas and a reactive gas with the cleaning liquid through the submerged fluid jet.

19 Claims, 3 Drawing Sheets

(56) References Cited

FOREIGN PATENT DOCUMENTS

| | | | |
|---|---|---|---|
| JP | 2000262992 | A | 9/2000 |
| JP | 2003024758 | A | 1/2003 |
| JP | 2005186045 | A | 7/2005 |
| JP | 2006214749 | A | 8/2006 |
| JP | 2007243113 | A | 9/2007 |
| JP | 2010135810 | A | 6/2010 |
| WO | WO-2011147781 | A1 | 12/2011 |

OTHER PUBLICATIONS

JPH0347575 English Translation, accessed on Nov. 2016.*
EP Search Report and Written Opinion dated Mar. 14, 2014 issued in connection with corresponding EP Patent Application No. 13183917.7.
Unofficial English Translation of Japanese Office Action issued in connection with corresponding JP Application No. 2013182657 dated Jun. 2, 2015.

* cited by examiner

METHODS OF CLEANING A SUBMERGED SURFACE USING A FLUID JET DISCHARGING A LIQUID/GAS COMBINATION

BACKGROUND

Field

The present disclosure relates to methods of cleaning a submerged surface.

Description of Related Art

To ensure safe operation, submerged reactor surfaces are periodically inspected for cracks that may jeopardize the integrity of the structure. That being said, the submerged reactor surfaces must be cleaned of unwanted buildup and deposits (also referred to as "dust") before the periodically required inspections can be conducted. The "dust" layer created by the high temperature, high radiation reactor environment adheres rather tightly to the affected surfaces and is relatively difficult to remove. Conventionally, the submerged reactor surfaces are mechanically cleaned using brush-type tools. However, this mechanical cleaning approach involving brush-type tools is not completely effective in removing the unwanted buildup and deposits from the submerged reactor surfaces. Additionally, this mechanical cleaning approach tends to leave behind brush debris (bristles, tufts, staples, and/or other broken-off components) in the reactor.

SUMMARY

Example embodiments herein relate to a method of cleaning a submerged surface covered by a liquid medium. The method includes injecting a cleaning liquid with a submerged fluid jet through the liquid medium at the submerged surface. The method may also include introducing at least one of a non-reactive gas and a reactive gas with the cleaning liquid through the submerged fluid jet.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
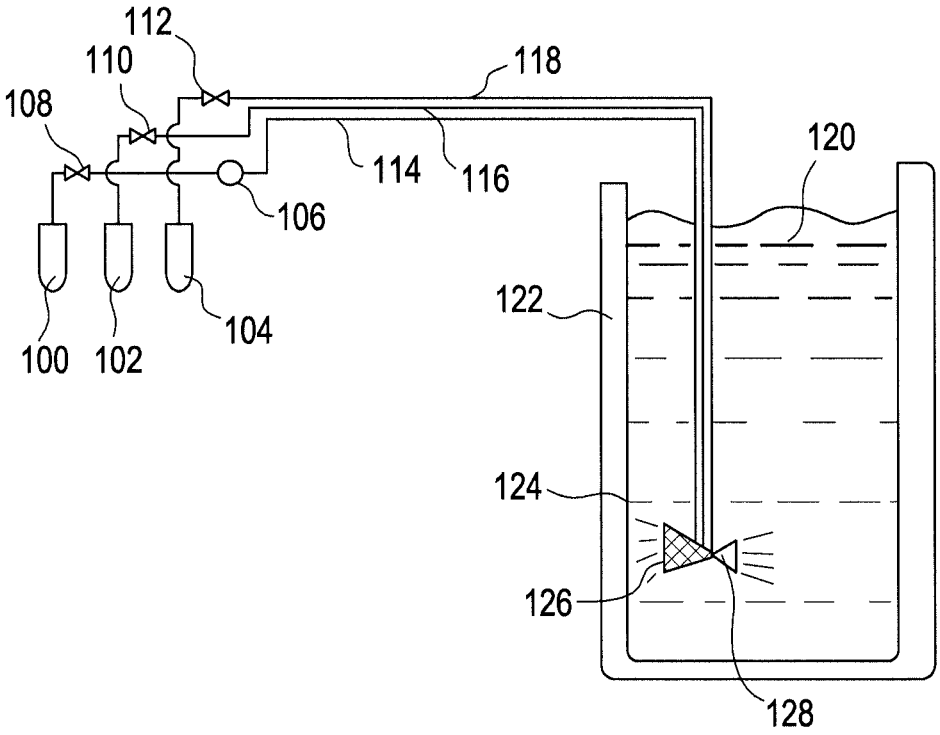
FIG. 1 is a schematic view of a method and an apparatus for cleaning a submerged surface.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is a schematic view of a method and an apparatus for cleaning a submerged surface. Referring to FIG. 1, an apparatus for cleaning a submerged surface includes a cleaning liquid supply 100, a non-reactive gas supply 102, and a reactive gas supply 104 connected to a fluid jet 126. The cleaning liquid supply 100 is configured to supply a cleaning liquid 100' (FIG. 2) to the fluid jet 126 through a cleaning liquid line 114 via a pump 106. The flow opening in the cleaning liquid line 114 may be regulated with a first valve 108. Similarly, the non-reactive gas supply 102 and the reactive gas supply 104 are configured to supply a non-reactive gas 102' and a reactive gas 104' (FIG. 2) to the fluid jet 126 through a non-reactive gas line 116 and a reactive gas line 118, respectively. The flow openings in the non-reactive gas line 116 and the reactive gas line 118 may be regulated with a second valve 110 and a third valve 112, respectively. Although not shown, it should be understood that one or more pumps may be provided to drive the non-reactive gas 102' and the reactive gas 104' from the non-reactive gas supply 102 and the reactive gas supply 104, respectively.

The fluid jet 126 may be arranged within a vessel 122 containing a liquid medium 120 so as to face a submerged surface 124 of the vessel 122. The liquid medium 120 may be water, although example embodiments are not limited thereto. During the operation of the fluid jet 126, the force generated by the fluids expelled therefrom may repel the fluid jet 126 and, thus, cause the fluid jet 126 to depart from an ideal or desired position relative to the submerged surface 124 of the vessel 122. To counter this repulsive force, the fluid jet 126 may be stabilized with a balancing jet 128. In particular, the balancing jet 128 may expel a secondary fluid in a direction opposite to the direction that the primary fluids are being expelled from the fluid jet 126. Although FIG. 1 illustrates a fluid jet 126 being used to clean an interior surface of the vessel 122, it should be understood that the fluid jet 126 may be used on a variety of other submerged surfaces (whether in a reactor facility or in other environments).

Figure 2:
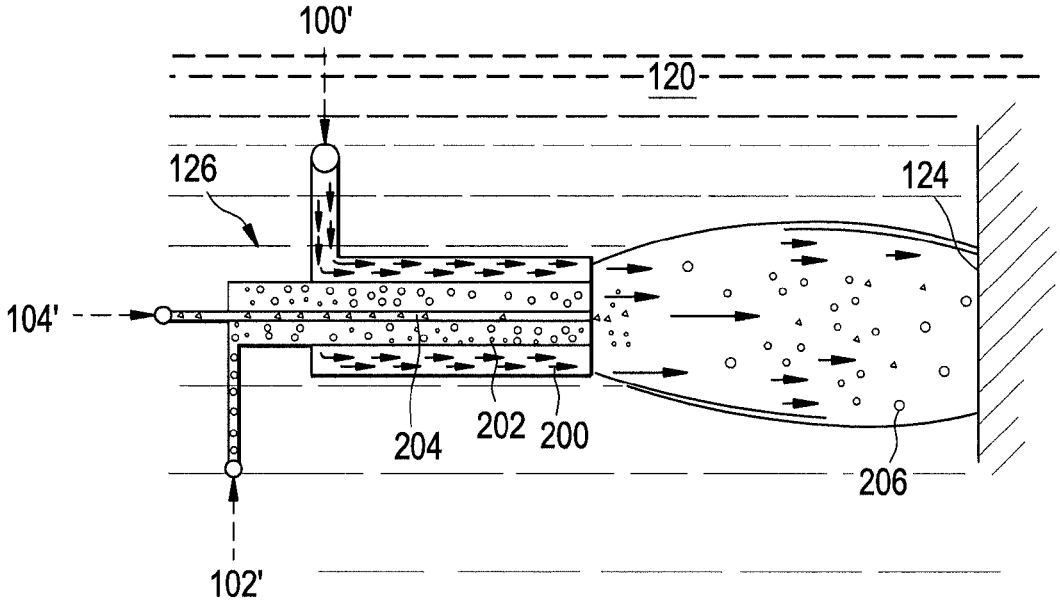
FIG. 2 is a cross-sectional view of the fluid jet of FIG. 1.

FIG. 2 is a cross-sectional view of the fluid jet of FIG. 1. Referring to FIG. 2, the fluid jet 126 is configured to include a first passage 200, a second passage 202, and a third passage 204. During operation of the fluid jet 126, the cleaning liquid 100' travels through the first passage 200, the non-reactive gas 102' travels through the second passage 202, and the reactive gas 104' travels through the third passage 204. The first passage 200, second passage 202, and third passage 204 are designed such that the cleaning liquid 100', non-reactive gas 102', and reactive gas 104' are isolated from each other while en route to and while within the fluid jet 126 and mix with each other when expelled from the fluid jet 126 into the liquid medium 120.

Figure 3:
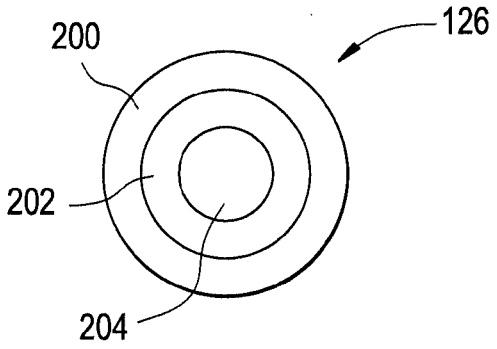
FIG. 3 is a front view of the fluid jet of FIG. 2.

FIG. 3 is a front view of the fluid jet of FIG. 2. Referring to FIG. 3, the fluid jet 126 may be configured such that the third passage 204 is concentrically arranged within the second passage 202. The second passage 202 may also be concentrically arranged within the first passage 200. The fluid jet 126 may be formed of a large cylinder structure, a medium cylinder structure arranged within the large cylinder structure, and a small cylinder structure arranged within the medium cylinder structure. The inner surface of the large cylinder structure and the outer surface of the medium cylinder structure define the first passage 200. The inner surface of the medium cylinder structure and the outer surface of the small cylinder structure define the second passage 202. The inner surface of the small cylinder structure defines the third passage 204. Additional details regarding the fluid jet 126 will be provided below in connection with methods of cleaning using the fluid jet 126.

A method of cleaning a submerged surface 124 covered by a liquid medium 120 includes injecting a cleaning liquid 100' with a submerged fluid jet 126 through the liquid medium 120 at the submerged surface 124. The method additionally includes introducing at least one of a non-reactive gas 102' and a reactive gas 104' with the cleaning liquid 100' through the submerged fluid jet 126. The "flame" of the fluid jet 126 facilitates the removal of "dust" and other unwanted materials from the submerged surface 124.

The injecting step may include directing the cleaning liquid 100' at an interior surface of a vessel 122 covered by the liquid medium 120. Alternatively, the injecting step may include directing the cleaning liquid 100' at a component immersed in the liquid medium 120 (e.g., a mechanical part within the vessel 122). However, it should be understood that the cleaning liquid 100' may be directed at any surface in need of cleaning. Furthermore, the injecting step may include using water as the cleaning liquid 100'.

The injecting and introducing steps may include configuring the submerged fluid jet 126 such that the cleaning liquid 100' and the at least one of the non-reactive gas 102' and the reactive gas 104' exit the submerged fluid jet 126 prior to mixing with each other. For example, the injecting and introducing step may be performed with a triple concentric tuyere as the submerged fluid jet 126. In such a situation, the cleaning liquid 100' may be injected through a first passage 200 of the triple concentric tuyere, the non-reactive gas 102' may be introduced through a second passage 202 of the triple concentric tuyere, and the reactive gas 104' may be introduced through a third passage 204 of the triple concentric tuyere. However, example embodiments are not limited thereto, and it should be understood that each of the cleaning liquid 100', the non-reactive gas 102', and the reactive gas 104' may be supplied through any of the first passage 200, the second passage 202, and the third passage 204. For instance, the non-reactive gas 102' may be supplied through the third passage 204, and the reactive gas 104' may be supplied through the second passage 202.

The injecting and introducing steps may include configuring the triple concentric tuyere such that the first passage 200 surrounds the second passage 202 and the third passage 204. With this configuration, supplying the cleaning liquid 100' through the outer first passage 200 will help focus the inner-supplied non-reactive gas 102' and/or reactive gas 104' during their path toward the submerged surface 124, thereby reducing their premature diffusion into the liquid medium 120 and enhancing the cleaning of the submerged surface 124. The injecting and introducing may also include configuring the triple concentric tuyere such that the second passage 202 and/or the third passage 204 extends further from the submerged fluid jet 126 than the first passage 200. Such a configuration may help to further reduce the premature diffusion of the non-reactive gas 102' and/or reactive gas 104' into the liquid medium 120 during their path toward the submerged surface 124.

The introducing step may include supplying the at least one of the non-reactive gas 102' and the reactive gas 104' as voids 206 (e.g., bubbles) that cavitate at an interface with the submerged surface 124 so as to facilitate a removal of deposits from the submerged surface 124. The introducing step may also include generating heat at an interface with the submerged surface 124 as a result of an absorption of the reactive gas 104' by at least one of the liquid medium 120 and the cleaning liquid 100'. The introducing step may further include increasing a pH at an interface with the submerged surface 124 as a result of an absorption of the reactive gas 104' by at least one of the liquid medium 120 and the cleaning liquid 100' so as to facilitate passivation of the submerged surface 124. As a result, a passive corrosion layer may be formed on the submerged surface 124.

During the cleaning of the submerged surface 124, the non-reactive gas 102' and the reactive gas 104' may be co-injected so as to be simultaneously introduced with the cleaning liquid 100'. At least one of atmospheric air, nitrogen, and a noble gas may be used as the non-reactive gas 102'. Additionally, at least one of ammonia and hydrazine may be used as the reactive gas 104'. However, it should be understood that example embodiments are not limited thereto and that other suitable gases may also be used as the non-reactive gas 102' and the reactive gas 104'. For instance, the introducing step may include the use of hydrogen chloride as the reactive gas 104'.

The use of water as the cleaning liquid 100' will result in the cleaning of the submerged surface 124 due to local fluid velocity. The local fluid velocity depends on the smoothness of the submerged surface 124, the impurities in the cleaning liquid 100' and the liquid medium 120, and the oxygen content of the cleaning liquid 100' and the liquid medium 120. The force acting on the submerged surface 124 of the vessel 122 is given by the following equation:

$$F=\rho qV/g \sin\theta$$

wherein

F is the force,

ρ is the density of the cleaning liquid 100', q is the volumetric flow rate of the cleaning liquid 100', V is the velocity of the cleaning liquid 100', g is a dimensionless conversion constant, and θ is the angle of inclination between the fluid jet 126 and the submerged surface 124.

When the cleaning liquid 100' is augmented with the non-reactive gas 102', a relatively high frequency vibration is generated, thereby enhancing the mechanical removal of "dust" from the submerged surface 124. In particular, the entrained bubbles of the non-reactive gas 102' collapse at the liquid-solid interface of the liquid medium 120 and the submerged surface 124 via a phenomenon called cavitation to cause the relatively high frequency vibration. Generally, the bubble radius of the non-reactive gas 102' exiting the nozzle of the fluid jet 126 will be about five times that of the nozzle diameter. The dynamic pulsating mode of the oscillation is given by the following equation:

$$f=\frac{1}{2\pi R}\sqrt{\frac{3\gamma P}{\rho}}$$

wherein f is the fundamental mode natural frequency,

R is the bubble radius (m) of the non-reactive gas 102',

γ is the gas specific heat ratio (e.g., 1.4 for $N_2$),

P is the mean static pressure (Pa), and

ρ is the density (kg/m$^3$) of the liquid medium 120.

When nitrogen ($N_2$) is used as the non-reactive gas 102' and assuming a nozzle diameter of 1 mm and a bubble radius of 5 mm, the frequency is about 600 Hz, although example embodiments are not limited thereto.

When the cleaning liquid 100' is augmented with the reactive gas 104' (with or without the non-reactive gas 102'), relatively high frequency vibrations with a larger magnitude acoustic pulse (acoustical pressure waves) are generated. Additionally, the absorption of the reactive gas 104' by the cleaning liquid 100' and/or liquid medium 120 causes a local temperature increase (heat of dissolution) while also causing dissolved gas to come out of solution. The resulting cavitation and heat increases the removal of "dust" from the submerged surface 124. Furthermore, the reactive gas 104' will cause a localized pH increase. The increased alkalinity decreases the corrosion rate by making the cleaned submerged surface 124 more passive.

In a non-limiting embodiment where ammonia ($NH_3$) is used as the reactive gas 104', the chemical reaction for the dissolution of ammonia ($NH_3$) in water ($H_2O$) is expressed below.

$$NH_3+H_2O \leftrightarrow NH_4^+ + OH^-$$

After the cleaning is complete and the reactor is started up, the resulting ammonium ions ($NH_4^-$) in the vessel 122 will undergo a radiological decomposition according to the following formula.

$$2NH_4 \rightarrow {}^{\gamma}2N_2+4H_2$$

Figure 4:
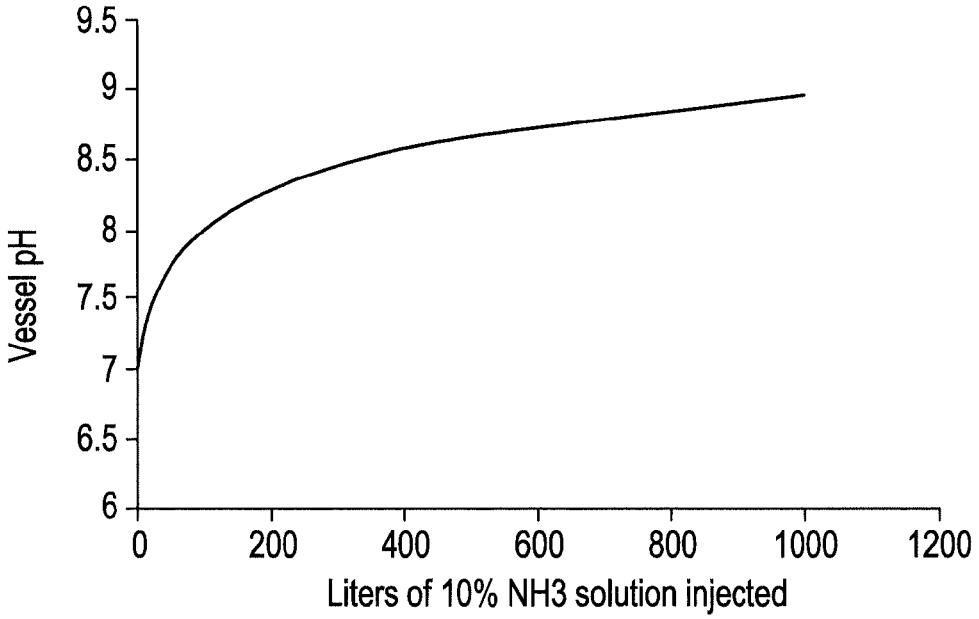
FIG. 4 is a graph showing the relationship between the pH of the liquid medium and the quantity of ammonia injected as the reactive gas.

FIG. 4 is a graph showing the relationship between the pH of the liquid medium and the quantity of ammonia injected as the reactive gas. The chemistry control in a typical boiling water reactor (BWR) is to maintain pure water with a conductivity of 0.10-0.15 μS/cm with a pH between 6.5-8.0. The effect of the introduction of ammonia as the reactive gas 104' during cleaning will likely be minimal in view of the relatively large volume of the liquid medium 120 in the vessel 122.

The method of cleaning the submerged surface 124 may further include stabilizing the submerged fluid jet 126 with a balancing jet 128. In such a case, a first force generated by a first jet exiting the submerged fluid jet 126 is countered by a second force generated by a second jet exiting the balancing jet 128. The magnitude of the first force may be about equal to that of the second force. Furthermore, the direction of the first force may be opposite that of the second force. As a result, the fluid jet 126 may be maintained in a desired position relative to the submerged surface 124.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A method of cleaning a submerged surface covered by a liquid medium, the method comprising:

injecting a cleaning liquid with a submerged fluid jet through the liquid medium at the submerged surface; and introducing at least one of a non-reactive gas and a reactive gas with the cleaning liquid through the submerged fluid jet such that the cleaning liquid and the at least one of the non-reactive gas and the reactive gas exit the submerged fluid jet prior to mixing with each other, and the cleaning liquid surrounds the at least one of the non-reactive gas and the reactive gas during the injecting and introducing so as to focus a discharge of the at least one of the non-reactive gas and the reactive gas toward the submerged surface, wherein the introducing includes generating heat at an interface with the submerged surface as a result of an absorption of the reactive gas by at least one of the liquid medium and the cleaning liquid.

2. A method of cleaning a submerged surface covered by a liquid medium, the method comprising:

injecting a cleaning liquid through a first conduit of a submerged fluid jet to an open end of the first conduit;

introducing at least one of a non-reactive gas and a reactive gas through a second conduit of the submerged fluid jet to an open end of the second conduit, the second conduit extending within the first conduit;

focusing the at least one of a non-reactive gas and a reactive gas exiting the submerged fluid jet to the submerged surface; and mixing substantially the cleaning liquid and the at least one of a non-reactive gas and a reactive gas after exiting from the submerged fluid jet, wherein the introducing includes generating heat at an interface with the submerged surface as a result of an absorption of the reactive gas by at least one of the liquid medium and the cleaning liquid.

3. The method of claim 2, wherein the introducing includes configuring the second conduit to extend within the first conduit to substantially isolate the cleaning liquid and the at least one of a non-reactive gas and a reactive gas while passing through the submerged fluid jet.

4. The method of claim 3, wherein the introducing includes configuring the open end of the second conduit to extend substantially to the open end of the first conduit.

5. The method of claim 3, wherein the introducing includes configuring the open end of the second conduit to extend beyond the open end of the first conduit.

6. A method of cleaning a submerged surface covered by a liquid medium, the method comprising:

injecting a cleaning liquid with a submerged fluid jet through the liquid medium at the submerged surface; and introducing at least one of a non-reactive gas and a reactive gas with the cleaning liquid through the submerged fluid jet such that the cleaning liquid and the at least one of the non-reactive gas and the reactive gas exit the submerged fluid jet prior to mixing with each other, and the cleaning liquid surrounds the at least one of the non-reactive gas and the reactive gas during the injecting and introducing so as to focus a discharge of the at least one of the non-reactive gas and the reactive gas toward the submerged surface, wherein the injecting and introducing is performed with a triple concentric tuyere as the submerged fluid jet, the cleaning liquid being injected through a first passage of the triple concentric tuyere, the non-reactive gas being introduced through a second passage of the triple concentric tuyere, and the reactive gas being introduced through a third passage of the triple concentric tuyere.

7. The method of claim 6, wherein the injecting includes directing the cleaning liquid at an interior surface of a vessel covered by the liquid medium.

8. The method of claim 6, wherein the injecting includes directing the cleaning liquid at a component immersed in the liquid medium.

9. The method of claim 6, wherein the injecting includes using water as the cleaning liquid.

10. The method of claim 6, wherein the injecting and introducing includes configuring the triple concentric tuyere such that the first passage surrounds the second passage and the third passage.

11. The method of claim 6, wherein the injecting and introducing includes configuring the triple concentric tuyere such that the third passage extends further from the submerged fluid jet than the first passage.

12. The method of claim 6, wherein the introducing includes supplying the at least one of the non-reactive gas and the reactive gas as voids that cavitate at an interface with the submerged surface so as to facilitate a removal of deposits from the submerged surface.

13. The method of claim 6, wherein the introducing includes increasing a pH at an interface with the submerged surface as a result of an absorption of the reactive gas by at least one of the liquid medium and the cleaning liquid so as to facilitate passivation of the submerged surface.

14. The method of claim 6, wherein the introducing includes a co-injection of the non-reactive gas and the reactive gas.

15. The method of claim 6, wherein the introducing includes the use of at least one of atmospheric air, nitrogen, and a noble gas as the non-reactive gas.

16. The method of claim 6, wherein the introducing includes the use of at least one of ammonia and hydrazine as the reactive gas.

17. The method of claim 6, wherein the introducing includes the use of hydrogen chloride as the reactive gas.

18. The method of claim 6, further comprising:

stabilizing the submerged fluid jet with a balancing jet such that a first force generated by a first jet exiting the submerged fluid jet is countered by a second force generated by a second jet exiting the balancing jet.

19. The method of claim 6, wherein the cleaning liquid surrounds the at least one of the non-reactive gas and the reactive gas so as to reduce a premature diffusion of the at least one of the non-reactive gas and the reactive gas during a path toward the submerged surface.

* * * * *